United States Patent [19]

Dowzall et al.

[11] 4,232,452

[45] Nov. 11, 1980

[54] APPARATUS FOR USE IN CONNECTION WITH DRY TRANSFER LETTERING AND ANALOGOUS SHEETS

[75] Inventors: Martin E. Dowzall, Wyckoff; Vazgen J. Houssian, Union City, N.J.

[73] Assignee: Letraset International Limited, London, England

[21] Appl. No.: 8,086

[22] Filed: Jan. 31, 1979

[30] Foreign Application Priority Data

Jan. 31, 1978 [GB] United Kingdom ..... 3882/78

[51] Int. Cl.[3] ..... B43L 7/00

[52] U.S. Cl. ..... 33/430; 402/503

[58] Field of Search ..... 33/430–447; 402/503

[56] References Cited

U.S. PATENT DOCUMENTS

| | | | |
|---|---|---|---|
| 1,600,545 | 9/1926 | Hooper | 33/437 |
| 3,008,470 | 11/1961 | Rubinstein | 402/503 |
| 3,032,040 | 5/1962 | Wakeman | 402/503 |
| 3,091,864 | 6/1963 | Force | 33/449 |

FOREIGN PATENT DOCUMENTS

| | | | |
|---|---|---|---|
| 1182480 | 2/1970 | United Kingdom | 402/503 |

*Primary Examiner*—Charles E. Phillips
*Attorney, Agent, or Firm*—Darby & Darby

[57] ABSTRACT

A drawing board device is described of particular value in composing signs using dry transfer lettering sheets. The board has a base and a horizontal rule mounted thereon and capable of moving vertically and horizontally. The rule has one or more magnetic clamps for sheets of transfer material, and one or more sets of register pins for registering with e.g. a preprinted line on or preprinted holes in the sheet. The vertical movement of the rules is preferably stepped, the interline spacing between the lines of letters on the sheet being an integral multiple of the step length.

9 Claims, 4 Drawing Figures

11
9
III
10
8
7
11
III
8
6
4
7

7
10
6
8
4
8
11
1
7
11

11
8
4

APPARATUS FOR USE IN CONNECTION WITH DRY TRANSFER LETTERING AND ANALOGOUS SHEETS

This invention relates to apparatus for use in connection with dry transfer lettering and analogous sheets.

In recent years the use of dry transfer lettering sheets has become widespread in a variety of applications. In particular, dry transfer lettering sheets are used in large quantities to produce legends on artwork, architectual drawings and engineering drawings and in the production of signs. In all of these applications it is desirable to align the letters relative to one another with very considerable accuracy in order that the resulting word or words looks correct to the eye. Because of the Vernier acuity of the human eye, even quite small departures from linearity show up very obviously, even to an untrained observer.

According to the present invention there is provided apparatus for use in conjunction with one or more sheets of dry transfer symbols which comprises a baseboard, a horizontal rule mounted thereon and capable of moving both horizontally and vertically, register pins on the rule for registration with predetermined positions on the sheet of dry transfer material and a magnetic clamp adapted to clasp one edge of the sheet of dry transfer material and hold it engaged on the pins.

Preferably the magnetic clamp takes the form of a hinged strip of flexible magnetic material which may be lifted away from the rule to expose two or more registration pins and allow the positioning of a sheet of dry transfer lettering thereon. Thereafter, the magnetic strip may be hinged down to hold the sheet of dry transfer material clamped firmly against the rule, which must naturally be made at least partly of a magnetic material.

The registration pins may be sharp and used to perforate the transfer sheet as it is positioned, e.g. at preprinted positions thereon, or they may be blunt and the transfer sheet provided with e.g. two preformed appropriately placed holes for fitting over the pins.

In a particularly preferred embodiment, the rule is of generally triangular cross-section having two faces equally oppositely sloped with respect to the plane of the baseboard and each face bearing a magnetic clamp and register pins. Thus, seen from the position of a user, the horizontally extending rule bears an upper clamp for clamping a sheet of dry transfer material extending upwardly over the baseboard and a lower clamp for bearing a like sheet of material extending downwardly.

The rule may be provided with associated guides and slides to enable it to be moved horizontally and vertically to the desired degree. Such mechanisms are known in architects' and engineers' drawing boards and do not need to be described further here. In particular, the rule may be a short rule horizontally slidable on a horizontally fixed vertically moveable rule extending across the entire width of the board, or the horizontal rule may be vertically slidable in a vertically extending carriage which is horizontally slidable on a rail at the upper horizontal edge of the board. In a particularly preferred embodiment, the apparatus is of this type and of the type defined above, and is provided with means which subdivide the vertical movement of the rule into a plurality of equally spaced steps. This is particularly advantageous where the interline spacing between the lines of images, usually letters and other typographical symbols, on the dry transfer sheet is a multiple of the length of each such step. For example, the rule may be arranged to be movable vertically in steps of size 3 mm. and adjacent lines of typographical symbols on the dry transfer sheet may have a spacing of e.g. 18, 21 or 24 mm.

The preferred embodiment in which two clamping members are provided is particularly advantageous in that it enables a sheet of upper case letters to be clamped in the upper clamp and a sheet of lower case letters to be clamped in the lower clamp. This is particularly of value in many sign making applications and the present invention is of particular value as an aid to the the assembly of an accurately aligned sign from a dry transfer lettering material.

In order to ensure proper location of the lines of images on the dry transfer sheet with the register pins in the rule, the dry transfer sheet may bear an appropriate mark for piercing by sharp pins or may have preformed apertures for registration with the pins. A mark is preferred since it can conveniently be printed at the same time as the dry transfer sheet is manufactured and accurate alignment and positioning relative to the indicia printed on the transfer sheet is automatically achieved. Thus for example the base and top of each dry transfer sheet may bear an alignment mark in the form of a line having near the left-hand end thereof a small circle. In use, the left-hand pin is pierced through the circle and the sheet then aligned so that the right-hand pin pierces the line. Thereafter the magnetic clamp strip is applied to hold the sheet firmly in that position.

The invention is illustrated by way of example with reference to the accompanying drawings in which.

Figure 1:
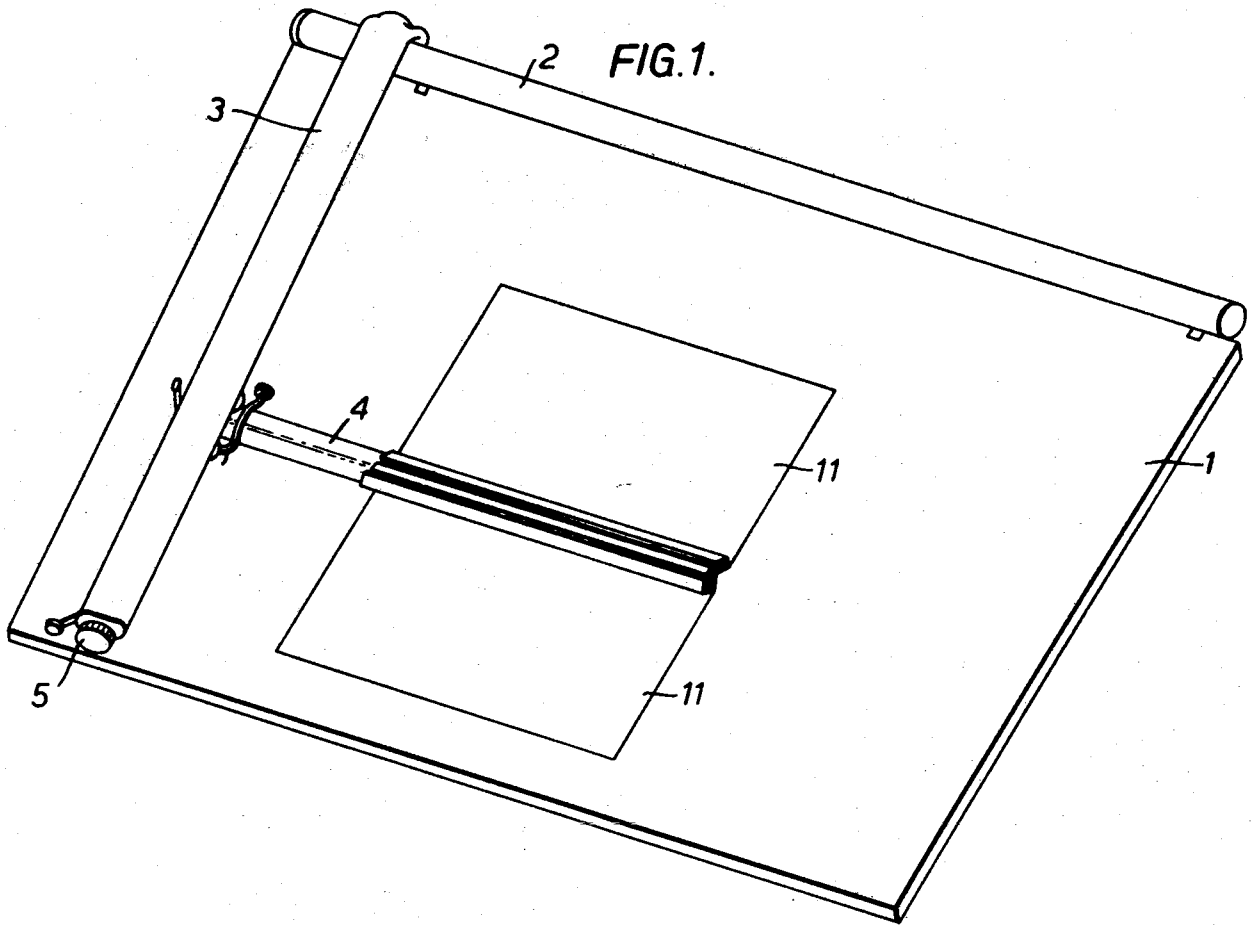
FIG. 1 is a perspective view from above of apparatus according to the present invention.
Figure 2:
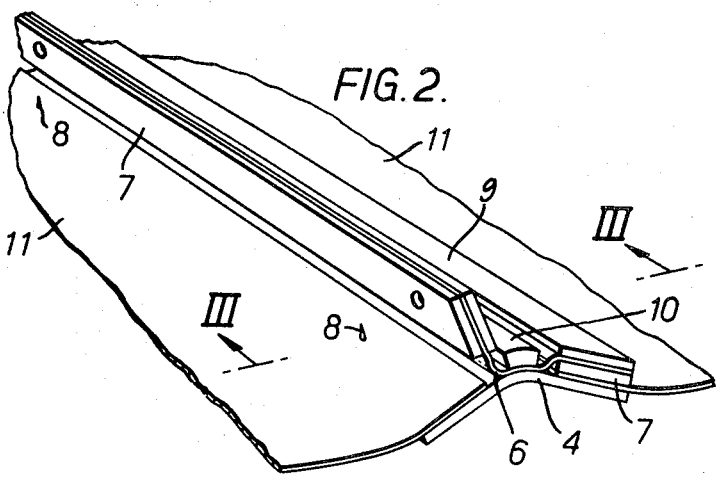
FIG. 2 is a perspective view on an enlarged scale of the free end of the rule of the device shown in FIG. 1.

Referring to the drawings the apparatus consists of a baseboard 1 having at one edge a rail 2 in which a vertical bar 3 slides. The mechanical connection between rail 2 and bar 3 is such that bar 3 is at right angles to rail 2. Bar 3 in turn carries a rule 4, accurately at right angles to bar 3. Rule 4 may slide up and down bar 3 in step-wise fashion by means of a sliding guide piece mounted in bar 3 and an associated screw thread of large pitch into the thread of which engages a spring loaded ball mounted on the slidable member. The screw may be rotated by means of a handle 5 so allowing the vertical position of rule 4 to be infinitely varied.

Figure 3:
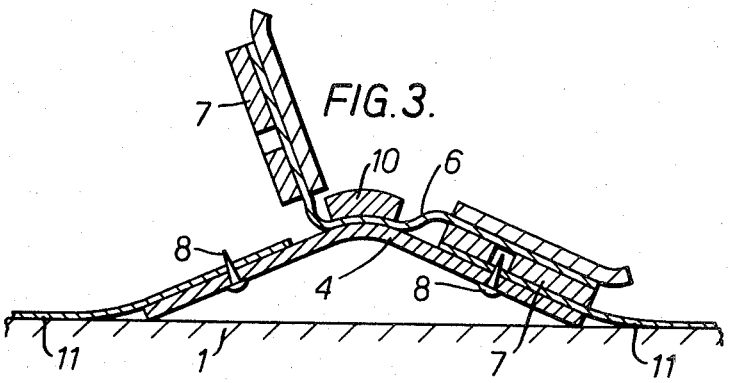
FIG. 3 is a cross-section along the lines III—III of FIG. 2 on a yet further enlarged scale.
Figure 4:
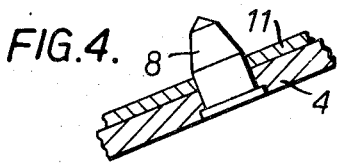
FIG. 4 is a detail of an alternative form of register pin, in a view similar to FIG. 3 but on an enlarged scale.

Rule 4 is made of steel, is of generally triangular cross-section and bears on its two inclined upper faces magnetic strips 7 attached by a flexible hinge 6 and backed by metal strips. The central portion of hinge 6 is adhered to rule 4 and backed by a metal bar 10. Each face of rule 4 bears two protruding pins 8, either sharp as in FIG. 3 or blunt as in FIG. 4.

In use, a sheet of dry transfer lettering 11 may be positioned on each side of rule 4 by lifting the magnetic strips 7, positioning the sheet on the pins 8 and lowering the magnetic strips firmly to clamp the sheet against the bar. The sheets may take up any one of a vertical positions by moving the rule up and down and the horizontal position may be adjusted by sliding bar 3 on rail 2.

The apparatus illustrated is of particular value in composing signs on a suitable substrate material which is merely stuck to the baseboard 1 e.g. using masking tape in known fashion and the rule is then moved to position the desired character over the desired position on the substrate material. Successive letters are rubbed down in this way until the desired legend is composed, whereafter the substrate bearing the legend may be removed from the board and used to make a sign. Horizontal alignment of the letters may be ensured by using the stepped vertical positioning of the rule 4 achieved by means of the screw and springloaded ball device in bar 3. Preprinted lines on sheets 11 which are aligned with the pins 8 ensure correct spacing (at an integral multiple of the screw pitch) between the sheet 11 above rule 4 and that below it. Correct lateral spacing may be achieved by using spacing marks printed on sheets 11 in known fashion.

We claim:

1. Apparatus for use in conjunction with a sheet of dry transfer symbols which comprises a baseboard, a horizontal rule mounted thereon and capable of moving both horizontally and vertically, register pins on the rule for registration with predetermined positions on the sheet of dry transfer material, and an upper magnetic clamp adapted to clasp one edge of the sheet of dry transfer material and hold it engaged on the pins, said sheet extending upwardly over the baseboard, and, a lower magnetic clamp for engaging a second sheet of dry transfer material, said second sheet extending downwardly over the baseboard on the opposite side of the rule, wherein the register pins are pointed and adapted to perforate the sheet of dry transfer material, and said clamps are movable from a first open position to a second closed position and include recesses for engaging said pins in said closed position.

2. Apparatus according to claim 1 wherein the magnetic clamp comprises a hinged strip of flexible permanently magnetic material which may be lifted away from the rule to expose at least two registration pins and allow the positioning of a sheet of dry transfer lettering thereon.

3. Apparatus according to claim 1 wherein the register pins are blunt and sized and spaced to register with pre-formed holes in the sheet of dry transfer material.

4. Apparatus according to claim 1 wherein the vertical movement of the rule is subdivided into a plurality of equally spaced steps.

5. Apparatus for use in conjunction with a sheet of dry transfer symbols which comprises a baseboard, a horizontal rule mounted thereon and capable of moving both horizontally and vertically, register pins on the rule for registration with predetermined positions on the sheet of dry transfer material, and a magnetic clamp adapted to clasp one edge of the sheet of dry transfer material and hold it engaged on the pins wherein the rule is of generally isosceles triangular cross-section having two faces equally oppositely sloped with respect to the plane of the baseboard and each face having a magnetic clamp and register pins.

6. Apparatus according to claim 5 wherein the magnetic clamp comprises a hinged strip of flexible permanently magnetic material which may be lifted away from the rule to expose at least two registration pins and allow the positioning of a sheet of dry transfer lettering thereon.

7. Apparatus according to claim 5 wherein the register pins are pointed and adapted to perforate the sheet of dry transfer material.

8. Apparatus according to claim 5 wherein the register pins are blunt and sized and spaced to register with pre-formed holes in the sheet of dry transfer material.

9. Apparatus according to claim 5 wherein the vertical movement of the rule is subdivided into a plurality of equally spaced steps.

* * * * *

UNITED STATES PATENT AND TRADEMARK OFFICE

CERTIFICATE OF CORRECTION

PATENT NO. : 4,232,452

DATED : November 11, 1980

INVENTOR(S) : Martin Dowzall et al

It is certified that error appears in the above-identified patent and that said Letters Patent are hereby corrected as shown below:

On The Title Page:

Change the name of the assignee from Letraset International Ltd. to ''Letraset Corp.''

Signed and Sealed this

*Twenty-second* Day of *December 1981*

|SEAL|

*Attest:*

GERALD J. MOSSINGHOFF

*Attesting Officer*

*Commissioner of Patents and Trademarks*